United States Patent [19]

Kastner

[11] 4,411,278

[45] Oct. 25, 1983

[54] CIGARETTE MAKING MACHINE

[76] Inventor: Arnold Kastner, 10220 Armand Lavergne, Montreal, Quebec, Canada

[21] Appl. No.: 286,539

[22] Filed: Jul. 24, 1981

[51] Int. Cl.[3] ..... A24C 5/02; A24C 5/66; A24C 5/42

[52] U.S. Cl. ..... 131/70; 131/75

[58] Field of Search ..... 131/70–78, 131/81 R

[56] References Cited

U.S. PATENT DOCUMENTS 3,127,900 4/1964 Kastner ..... 131/70

FOREIGN PATENT DOCUMENTS 643473 6/1962 Canada .

*Primary Examiner*—V. Millin

*Attorney, Agent, or Firm*—Browdy and Neimark

[57] ABSTRACT

Cigarette making machine and method of manufacture. The machine is of the type where a supply of tobacco for a single cigarette is compacted within a chamber and is then injected into a preformed paper cigarette tube by means of a spoon. In the invention, movable component parts are carried by an assembly plate formed from a single blank of sheet metal, the chamber and means to guide the spoon are provided by bending portions of the blank. The assembly plate is secured to a plastic outer housing by deforming heated plastic locator projections provided within the housing into contact with the plate.

6 Claims, 4 Drawing Figures

CIGARETTE MAKING MACHINE

The present invention relates to a cigarette making machine for domestic use and to a method of manufacturing such a machine.

Machines of this general type are used with preformed tubes of cigarette paper and a supply of tobacco to produce what may be called home-made cigarettes. The advantage of such machines is basically to lower the cost of cigarettes to the consumer, but many users enjoy the freedom of being able to blend various tobaccos to provide differing tastes.

The main purpose of the present invention is to provide an improved machine and a method of making the machine which results in considerable savings in manufacturing costs and time and which saving can then be passed to the consumer as a reduction in the cost of a machine which lowers the cost of cigarettes to the consumer.

DISCUSSION OF PRIOR ART

Machines of this general type are well known and have achieved substantial commercial success. However, the known machines are relatively costly in manufacture requiring skilled labour for satisfactory assembly, and with rising labor and machinery costs, the cost of a finished machine to the consumer is approaching a point where the cost of home-made cigarettes is approaching the costs of the tailor-made variety.

A typical machine of this general type forms the subject of applicant's U.S. Pat. No. 3,127,900, granted Apr. 7, 1964 and Canadian Pat. No. 643,473, issued June 22, 1962. Machines of the type as shown in these Patents have achieved substantial commercial success over the years, and their sole disadvantage is that they are fabricated completely from metal component parts which are stamped individually from metal sheet and which have then to be assembled by skilled workmen through various steps involving placing and spot-welding to provide a finished product. The stamping of the various component parts and the skilled assembly of these known machines is approaching a production cost rendering the machines unattractive to potential purchasers.

PURPOSE AND OBJECTS OF THE PRESENT INVENTION

The principal object of the present invention is to provide a machine of the general type as discussed above and to a method of making such a machine, which is substantially less costly in production than prior art devices and yet which provides to the consumer a machine which is equal to or superior to the known devices.

A further object of the present invention is to provide a cigarette making machine of the type wherein a supply of tobacco for a single cigarette is compacted into cylindrical form within a tobacco compacting chamber which tobacco forms is then axially moved by an elongate spoon and injected by the spoon into a preformed cigarette tube positioned exteriorly of the machine on a hollow nipple, the improvement wherein movable component parts of the machine are carried by a metal assembly plate formed from a single blank of sheet metal, upper and lower spaced and parallel surfaces of the tobacco compacting chamber and guide means for guiding movement of the spoon being provided by bending of portions of the single blank.

A still further object is to provide an assembly plate for domestic cigarette making machines of the type wherein a supply of tobacco for a single cigarette is compacted into cylindrical form within a tobacco-compacting chamber and which tobacco form is axially moved by an elongate spoon and injected by the spoon into a preformed cigarette tube positioned exteriorly of the machine on a hollow nipple, the assembly plate being adapted to carry movable component parts of the machine, and being formed from a single formed blank of sheet metal, upper and lower surfaces of the tobacco compacting chamber and guide means for guiding movement of the spoon being provided during forming of the assembly plate.

A further purpose and object is to provide a method for the manufacture of a cigarette making machine of the type wherein a supply of tobacco for a single cigarette is compacted into cylindrical form within a tobacco compacting chamber which tobacco form is then axially moved by an elongate spoon and injected by the spoon into a preformed cigarette tube positioned exteriorly of the machine on a hollow nipple, comprising forming an assembly plate for carrying all movable component parts of the machine from a single blank of sheet metal, and bending portions of the blank to form upper and lower surfaces of the tobacco compacting chamber and to form guide means to guide movement of the elongate spoon, and securing the formed assembly plate within a supporting shell of plastic material and mounting movable component parts thereon.

The above objects and purposes and other advantages are realized by the present invention as a result of substantial savings in material and in particular labour costs. These savings are the result of a new manufacturing method which enables the elimination of a number of component parts previously thought to be necessary for successful operation and to increased speed of production lowering labour cost per unit.

DESCRIPTION OF ACCOMPANYING DRAWINGS

Reference will now be had to the accompanying drawings wherein:

FIG. 1 illustrates in perspective view a machine of the type as shown in U.S. Pat. No. 3,127,900 and Canadian Pat. No. 643,473 and which machine has an outward appearance quite similar to the machine according to the present invention;

DETAILED DISCUSSION OF ACCOMPANYING DRAWINGS

Figure 1:
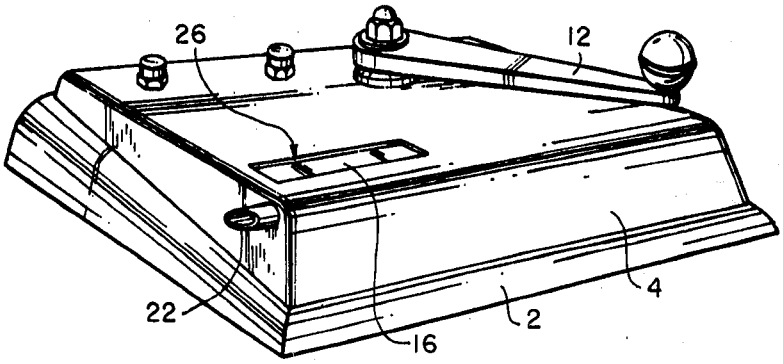

As indicated above, attached FIG. 1 illustrates in perspective view the outward appearance of a cigarette making machine of the type shown in U.S. Pat. No. 3,127,900 and Canadian Pat. No. 643,473, and FIG. 2 illustrates a bottom view of the machine as shown in FIG. 1.

Figure 2:
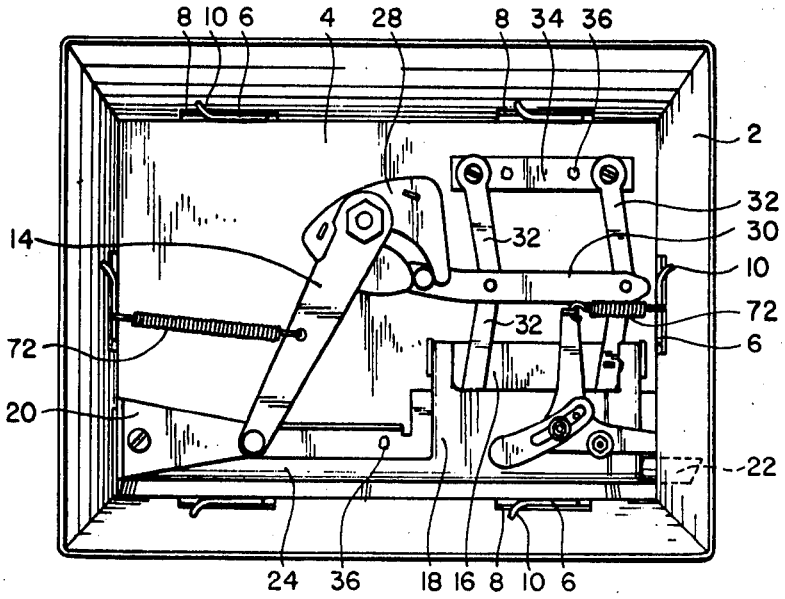
Fig 2 PRIOR ART
FIG. 2 illustrates in bottom view the construction of the machine according to the above discussed patents, showing movable component parts which are common to both the old and new devices.

The operation of a cigarette making machine of the type as shown in attached FIGS. 1 and 2 is well detailed in applicant's earlier patents discussed above, but a brief description of the construction and use of the machine is given here for convenience.

The device of FIGS. 1 and 2 consists of a metallic base or skirt portion 2 and an upper portion 4 which carries the moving component parts and which components are formed from metal sheet.

The upper portion 4 is formed with downwardly extending metallic tabs 6 which are received within cutouts 8 provided in the base 2 and when the tabs are suitably positioned, their ends 10 are bent outwardly as shown in FIG. 2 to hold the parts 2 and 4 together in secure relationship.

The moving component parts of the device are carried on the underside of top section 4 and are shown in some detail in FIG. 2. The machine is operated by rotation of handle 12 which is keyed to operating arm 14 and movement of the handle 12 results in the movement of a tobacco compacting member 16 reciprocably in a tobacco compacting chamber 18 while at the same time causing movement of a tobacco injecting spoon assembly (shown only partially at 20) into a cigarette tube positioned on nipple 22 shown in FIG. 1.

The spoon (not shown) is carried within a semi-circular housing 24 which in this prior device is formed integrally with the tobacco compacting chamber 18 from a single piece of metal sheet.

In use, handle 12 is rotated to withdraw the tobacco compacting member 16 from beneath filling aperture 26 (see FIG. 1) and a pre-formed cigarette tube (not shown) is positioned on the end of nipple 22. A supply of tobacco sufficient for one cigarette is then positioned in the tobacco compacting chamber 18 through opening 26 and handle 12 is rotated. This rotation moves the tobacco compacting member 16 to the tobacco compacting position as shown in FIGS. 1 and 2 and this is the result of interaction between cam member 28, central arm 30, and linkage members 32. This results in the tobacco being compacted in generally cylindrical form against a semi-circular spoon member (not shown) which upon further rotation of handle 12, moves to the right in FIG. 2, (as a result of movement to the right of operating arm 14) injecting the cylindrical wad of tobacco into a preformed cigarette tube positioned on the nipple 22. This results in a finished cigarette and the handle 12 is then returned to the starting position so that a new cigarette can be made.

In the manufacture of the machine as shown in FIGS. 1 and 2, the fabrication of the lower portion 2 and the upper assemblying carrying portion 4 is from sheet metal. In this prior unit, and after the forming of upper unit 4, a spacer arm 34 is separately stamped and secured by spot welding (as shown at 36) to the undersurface of top 4, and a tobacco compacting chamber 18 and integral spoon guiding groove 24 which are formed from a further piece of sheet material are then secured to the top section 4 by spot welding (see 36) in the position as shown in FIG. 2. The stamping and forming of these various component parts all add to the cost of production of the previous model.

The manufacture of the machine according to the present invention (the operation of which is similar to the operation of the prior device as discussed above) will now be discussed with reference to accompanying FIGS. 3 and 4.

Figure 3:
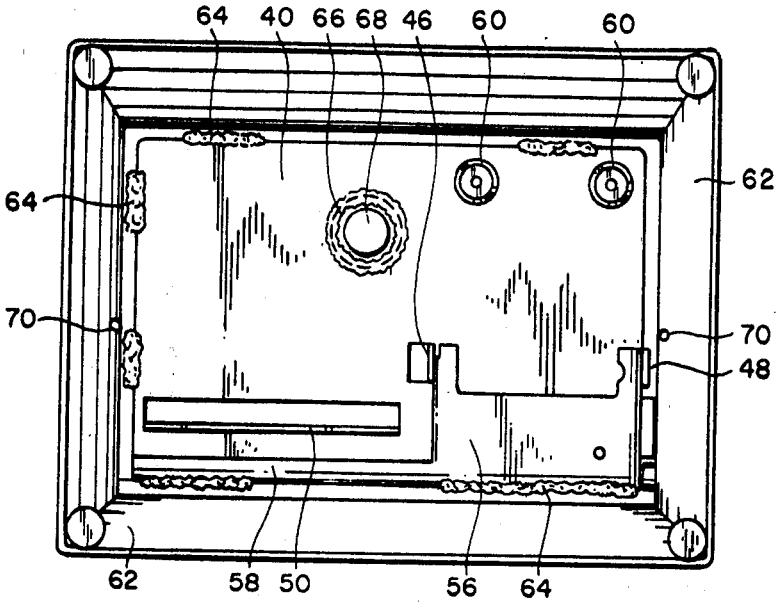
FIG. 3 illustrates in bottom view a portion of the machine according to the present invention.
Figure 4:
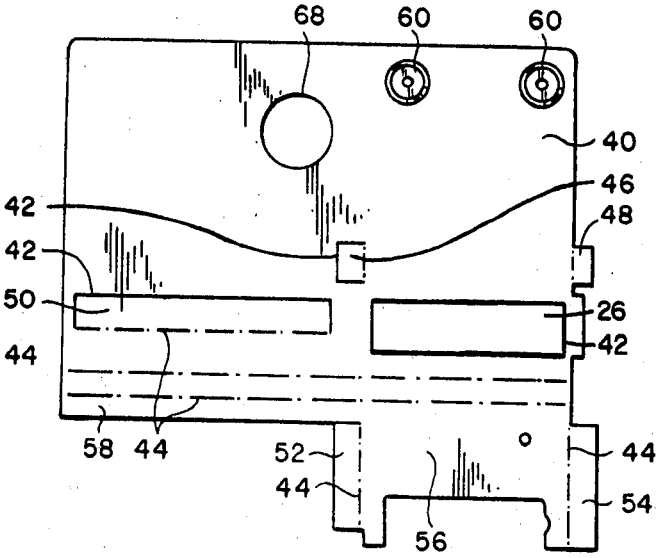
FIG. 4 illustrates a blank according to the present invention which is formed in economical manner to provide an assembly plate for carrying the various movable component parts of the new device.

According to the present invention, an assembly plate 40 adapted to carry the various movable parts of the machine is stamped from a single sheet of metal as shown in FIG. 4. After the stamping of the blank as shown in FIG. 4, it is then bent into the desired operational configuration as shown in FIG. 3. With respect to FIG. 4, the solid lines 42 (for example around filling aperture 26) represent cuts in the sheet material whereas the broken lines 44 represent lines about which various portions are bent. After stamping of the plate as shown in FIG. 4, tobacco compacting chamber securing tabs 46 and 48 are bent upwardly to the position shown in FIG. 3; and the rectangular metal flange portion 50 is bent upwardly to the position as shown in FIG. 3.

Tobacco compacting chamber flanges 52 and 54 are then bent upwardly, and the portions 56 and 58 of the blank as shown in FIG. 4 are bent in a fashion whereby the overlie portions of the assembly plate 40 in spaced and parallel relationship as shown in FIG. 3. Assembly plate portion 56 forms the lower surface of the tobacco compacting chamber; and portion 58 forms in combination with flange 50 a guideway for the spoon assembly. It is then simply a matter of securing tabs 46, 48 to flanges 52, 54 respectively, by suitable means such as by spot welding to provide a finished assembly plate ready to receive the various operating components of the device. Thus, by using a blank stamped sheet as shown in FIG. 4, the necessity of having to individually form and position separate component pieces is avoided.

The present procedure also avoids the necessity of having to provide a separate spacer bar 34, the purpose the prior art spacer arm being to hold the related link members 32 a distance away from the surface of the assembly plate to provide suitable cooperation between these links and the remaining component parts of the machine. In the invention, the spacer bar is eliminated and the links are raised from the support plate by the use of upstanding projections 60 which are formed during stamping of the assembly plate.

The assembly plate thus formed is then ready for securement to an overlying and supporting plastic housing shown generally by numeral 62.

The plastic housing 62 is formed by suitable plastic molding techniques, and the overall outward appearance of the machine is similar to that as shown in FIG. 1 with the exception that the lower 2 and upper 4 portions are plastic and are molded as a single unitary plastic shell which receives and supports the formed assembly plate of the invention.

During formation of the plastic housing, suitable plastic locator projections 64 are formed in the plastic material and after positioning of the assembly plate, these locators are heated and the plastic material flattened into contact around peripheral edges of the assembly plate 40 to secure the assembly plate firmly to the plastic housing 62. This securement is shown in attached FIG. 3, wherein the deformed plastic locators are shown at 64. Further securement may be provided by providing a plastic locator collar 66 around the handle shaft opening 68 and which is also heated and flattened.

During molding of the plastic housing interior studs 70 are formed to provide anchoring means for springs 72 (see FIG. 2) associated with movable component parts of the machine.

I claim:

1. In a cigarette making machine of the type wherein a supply of tobacco for a single cigarette is compacted into cylindrical form within a tobacco compacting chamber which tobacco form is then axially moved by an elongate spoon and injected by the spoon into a preformed cigarette tube positioned exteriorly of the machine on a hollow nipple, the improvement wherein movable component parts of the machine are carried by an assembly plate comprising a single blank of sheet metal, upper and lower spaced and parallel surfaces of the tobacco compacting chamber and guide means for guiding movement of the spoon comprising bent portions of the single blank, wherein said assembly plate is carried within and secured to an outer plastic shell, said shell including locator projections which are deformed into firm contact with said assembly plate.

2. In a cigarette making machine the improvement according to claim 1 wherein during forming of the assembly plate blank upstanding projections are formed in the plate, the projections spacing movable linkage members of the machine a distance from the assembly plate.

3. In a cigarette making machine the improvement according to claim 1, the shell of plastic material being provided interiorly with upstanding studs to provide anchoring means for springs associated with movabe component parts of the machine.

4. A method for the manufacture of a cigarette making machine of the type wherein a supply of tobacco for a single cigarette is compacted into cylindrical form within a tobacco compacting chamber which tobacco form is then axially moved by an elongate spoon and injected by the spoon into a preformed cigarette tube positioned exteriorly of the machine on a hollow nipple;

comprising forming an assembly plate for carrying all movable component parts of the machine from a single blank of sheet metal;

bending portions of the blank to form upper and lower surfaces of the tobacco compacting chamber and to form guide means to guide movement of the elongate spoon;

positioning the assembly plate within a molded supporting shell of plastic material having locator projections formed therein to locate positioning of the assembly plate;

and heating and deforming the locator projections into firm contact with the assembly plate.

5. A method according to claim 4, including forming upstanding projections in the assembly plate, the projections spacing linkage members of the machine from the assembly plate.

6. A method according to claim 4, including forming upstanding studs interiorly of the plastic shell during molding, the upstanding studs providing anchoring means for springs associated with movable component parts of the machine.

* * * * *